US005358424A

United States Patent [19]

Bowen et al.

[11] Patent Number: 5,358,424

[45] Date of Patent: Oct. 25, 1994

[54] ELECTRICAL CONNECTOR FOR HIGH DENSITY RIBBON CABLE

[75] Inventors: David C. Bowen; Frank A. Harwath, both of Downers Grove; Jerry A. Long, Elgin, all of Ill.

[73] Assignee: Molex Incorporated, Lisle, Ill.

[21] Appl. No.: 105,224

[22] Filed: Aug. 11, 1993

[51] Int. Cl.[5] ..... H01R 4/24

[52] U.S. Cl. ..... 439/405; 29/857; 439/499

[58] Field of Search ..... 439/395, 399, 404, 405, 439/400, 417, 492, 494, 499; 29/857

[56] References Cited

U.S. PATENT DOCUMENTS

| | | | |
|---|---|---|---|
| 4,009,922 | 3/1977 | Aysta | 339/99 R |
| 4,026,625 | 5/1977 | Roiko et al. | 339/99 R |
| 4,441,779 | 4/1984 | Foederer et al. | 339/99 R |
| 4,601,530 | 7/1986 | Coldren et al. | 339/103 M |
| 4,857,010 | 8/1989 | Ponn | 439/417 |
| 4,913,660 | 4/1990 | Hirai | 439/396 |
| 4,948,381 | 8/1990 | Saito et al. | 439/405 |
| 4,978,314 | 12/1990 | Maejima | 439/417 X |
| 5,120,235 | 6/1992 | Kashiwa | 439/405 |
| 5,120,244 | 6/1992 | Saito et al. | 439/395 |

FOREIGN PATENT DOCUMENTS

| | | | |
|---|---|---|---|
| 0323340 | 7/1989 | European Pat. Off. | 439/405 |

OTHER PUBLICATIONS

20th Annual Connectors & Interconnection Technology Symposium Catalog pp. 220–229 Dated Oct. 19–21 1987.

*Primary Examiner*—Eugene F. Desmond
*Attorney, Agent, or Firm*—Charles S. Cohen

[57] ABSTRACT

An electrical connector is provided for insulation displacing termination of ribbon cable having insulated conductors in predetermined close centerline spacing. The connector includes a dielectric housing having a mating face, an opposed cable-receiving face and a plurality of terminal-receiving passages extending between the faces for receiving a plurality of terminals. Each terminal includes a mating portion toward the mating face and slotted U-shaped insulation displacement portion toward the cable-receiving face. The insulation displacement portions of the terminals are arranged staggered in at least two rows. A dielectric cover forces the conductors into the U-shaped insulation displacement portions and embraces the cable between the cover and the cable-receiving face of the housing. The cover includes a surface for engaging the cable and recesses in the surface for receiving the U-shaped insulation displacement portions of the terminals. The surface of the cover defines a plurality of parallel conductor support channels. Each channel defines upper and lower conductor support levels arranged such that a lower conductor support level of one channel is between two upper conductor support levels of adjacent channels. Projections are formed in each channel to hold a respective conductor therein. Therefore, the ribbon cable can be pressed into the conductor support channels of the cover and held on the cover for subsequent termination of the cable to the terminals on the connector housing.

11 Claims, 5 Drawing Sheets

ELECTRICAL CONNECTOR FOR HIGH DENSITY RIBBON CABLE

FIELD OF THE INVENTION

This invention generally relates to the art of electrical connectors and, particularly, to an electrical connector assembly for terminating a multi-conductor flat cable such as a ribbon cable.

BACKGROUND OF THE INVENTION

Electrical connectors have been provided in a wide variety of configurations for terminating multi-conductor cables such as integral flat or ribbon cables. With the ever-increasing miniaturization of electrical connectors and the ever-increasing numbers of wires in multi-conductor cables, electrical connectors of the character described have become increasingly complicated in order to accommodate relatively large numbers of conductors terminated in relatively small connectors. For instance, a ribbon cable may have conductors on close centerline spacing on the order of .025 inches. Connectors for such high density ribbon cables are used in a variety of applications, such as connecting disk drives in computers.

Most electrical connectors for terminating ribbon cables are of the insulation displacing termination type. These connectors generally include a housing having a mating face, an opposed cable-receiving face, and at least two rows of terminal-receiving passages extending between the faces. A plurality of terminals, most often stamped and formed of sheet metal material, are received in respective passages, each terminal having a mating portion toward the mating face of the housing and a generally U-shaped insulation displacement portion toward the cable-receiving face of the housing. Some form of secondary housing component, such as a cover, is provided for forcing conductors of the ribbon cable into the U-shaped insulation displacement portions of the terminals, with the cover embracing the ribbon cable between the cover and the cable-receiving face of the housing.

One of the problems with connectors of the character described immediately above, centers around the high density of the conductors in the ribbon cable. Because of the close spacing of the conductors, the insulation displacement portions of the terminals are arranged in two generally spaced-apart staggered rows with adjacent terminals located in opposite rows. Therefore, a conductor to be terminated in an insulation displacement portion located in a back row will necessarily have to pass between two insulation displacement portions located in a front row. The close spacing of the conductors and terminals may create problems and may result in shorting. One solution to this particular problem is to utilize the so-called "hill and dale" system which locates portions of adjacent conductors at the insulation displacement sections of adjacent terminals in different vertical positions or levels. However, molding the connector components for effecting this approach may be rather complicated and expensive.

More particularly, in a "hill and dale" system or connector, the cover has a cable-embracing face with a profile defined by a plurality of parallel conductor support channels. Each channel defines upper and lower conductor support levels arranged such that a lower conductor support level of one channel is between two upper conductor support levels of adjacent channels.

The cable-receiving face of the connector housing has a similar multi-level channel configuration which is a mirror image of the configuration or profile of the cable-embracing face of the cover. Therefore, the channelled faces of the cover and the housing sort of "mesh" during termination of the conductors of the ribbon cable. Of course, it can be understood that major modifications may be required to the connector housing in order to provide the channelled cable-receiving face complementary to the channelled cable-embracing face of the cover. It would be desirable to provide a similar system wherein the main connector housing does not have to be modified, and modifications only need be made to the cover or secondary housing component. This invention is directed to that end.

Still further, "hill and dale" systems as well as other insulation displacement systems of the prior art, namely those systems which incorporate a mirror imaged cable-receiving face on the connector housing complementary to the cable-embracing face on the cover, have not proven to be precise and consistent in their terminations. This is due to the inability over time to mold plastic components with sufficient precision and consistency to accommodate such closely spaced terminals. According to another aspect of the invention, tooling can be used to force the conductors of the ribbon cable into the conductor support channels of the secondary housing component or cover and held thereinto by a novel conductor hold down means.

SUMMARY OF THE INVENTION

An object, therefore, of the invention is to provide a new and improved insulation displacement connector assembly for high density ribbon cable.

In the exemplary embodiment of the invention, an electrical connector is disclosed for insulation displacing termination of ribbon cable having insulated conductors on predetermined close centerline spacing. The connector includes a housing having a mating face, an opposed cable-receiving face and a plurality of terminal-receiving passages extending between the faces. A plurality of terminals are received in the passages. Each terminal includes a mating portion toward the mating face of the housing and a slotted U-shaped insulation displacement portion toward the cable-receiving face of the housing. The insulation displacement portions of the terminals are arranged staggered in at least two rows. A dielectric cover is provided for forcing the conductors into the U-shaped insulation displacement portions and embracing the cable between the cover and the cable-receiving face of the housing. The cover includes surface means for engaging the cable and recess means in the surface means for receiving the U-shaped insulation displacement portions of the terminals.

The invention contemplates that the surface means of the cover define a plurality of parallel conductor support channels. Each channel defines upper and lower conductor support levels arranged such that a lower conductor support level of one channel is between two upper conductor support levels of adjacent channels. Conductor hold down means are operatively associated with each channel to hold a respective conductor therein. Therefore, the ribbon cable can be pressed into the conductor support channels of the cover and held on the cover for subsequent termination of the cable to the terminals on the connector housing.

In the preferred embodiment of the invention, the recess means are provided by transverse slots in the upper conductor support levels. The conductor support channels are spaced on the order of 25 mils to accommodate a 25 mil conductor centerline spacing of the ribbon cable. The cover is molded of dielectric material such as plastic, and the conductor hold down means are provided by integral projections which protrude into each conductor support channel above the lower conductor support level thereof.

The invention also contemplates the provision of a ribbon cable in which the insulation thereof is cut between the conductors in an area embraced by the cover at the conductor support channels. Therefore, precise tooling can be used to cut or slit the ribbon cable and then to press the separated conductors into the conductor support channels of the cover.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
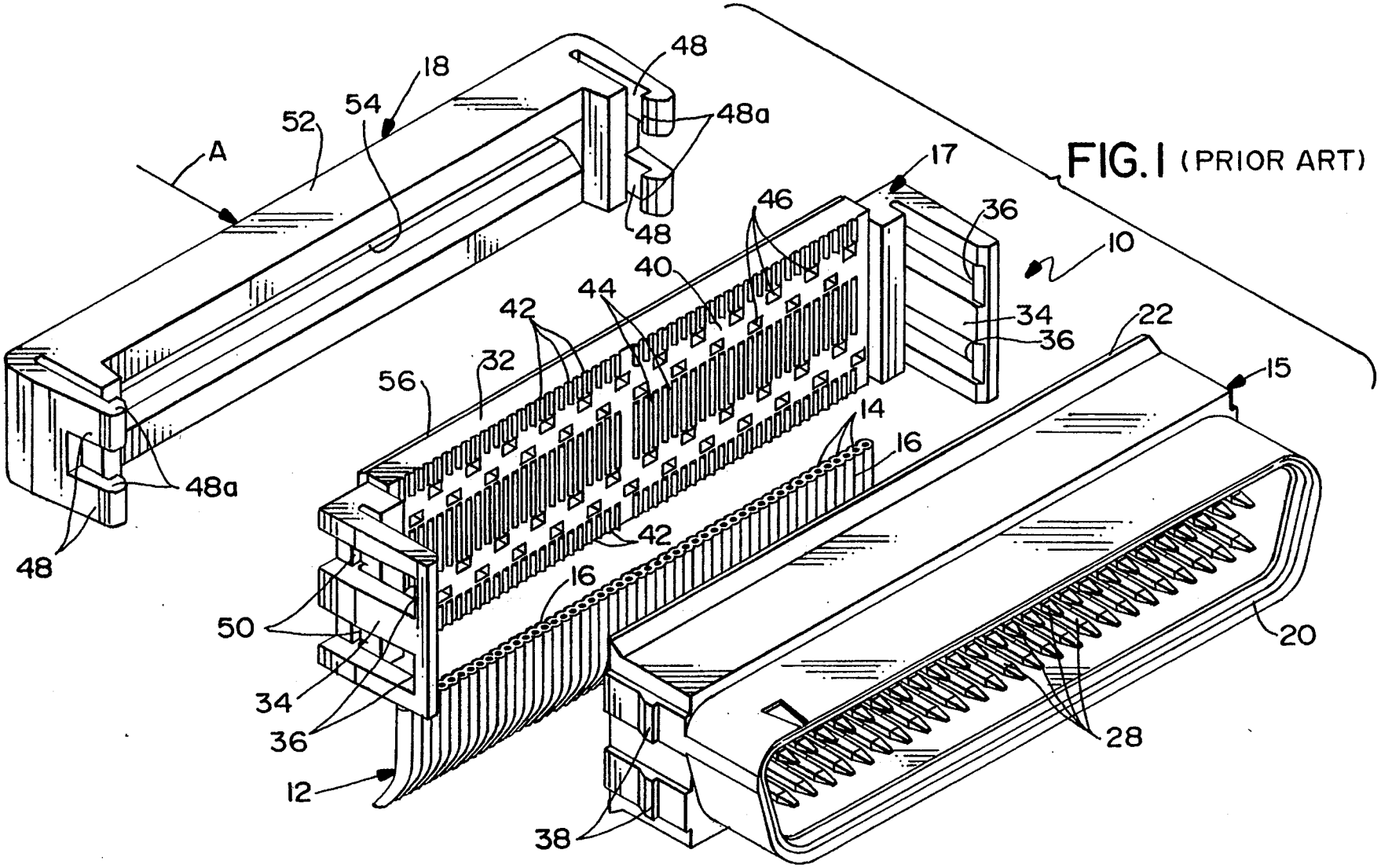
FIG. 1 (PRIOR ART)
FIG. 1 is an exploded perspective view of an electrical connector assembly of the prior art, for insulation displacement termination of a ribbon cable.

Referring to the drawings in greater detail, and first to FIG. 1, an electrical connector assembly of the prior art, generally designated 10, is shown for insulation displacing termination of a ribbon cable, generally designated 12. The ribbon cable is of a conventional configuration and has a plurality of conductors 14 on predetermined close centerline spacing. The conductors are surrounded by insulation which also integrally joins adjacent conductors, as is well known in the art. Therefore, opposite faces 16 of the integral flat ribbon cable are undulated transversely of the cable.

Prior art connector 10 includes a housing, generally designated 15, a cover, generally designated 17, and a strain relief member, generally designated 18. All of these three connector components are elongated transversely of ribbon cable 12 as is shown in the drawings. Housing 15 includes a mating face 20, an opposed cable-receiving face 22 and a plurality of terminal-receiving passages 24 extending between the faces. A plurality of terminals, generally designated 26, are received in passages 24. Each terminal includes a mating portion or pin 28 toward mating face 20 of housing 15 and a slotted U-shaped insulation displacement portion 30 toward cable-receiving face 22. As will be more clearly described below, insulation displacement portions 30 are arranged staggered in two pairs of two rows longitudinally of housing 15 and connector assembly 10.

Cover 17 is unitarily molded of dielectric material, such as plastic or the like, and includes an elongated, generally flat body portion 32 having resilient latch arms 34 at opposite ends thereof. The latch arms have openings 36 which snap over latch bosses 38 at opposite ends of housing 15. Generally, cover 17 operates to force conductors 14 of ribbon cable 12 into the U-shaped insulation displacement portions 30 of terminals 26 and embrace the cable between the cover and cable-receiving face 22 of the housing. More particularly, the cover includes an inner flat surface 40 for engaging the cable. A plurality of troughs 42 along opposite edges of surface 40 and a plurality of troughs 44 along the center of surface 40 are provided for registering with the conductors of the ribbon cable. In essence, the troughs match the undulated sides 16 of the ribbon cable.

It can be seen in FIG. 1 that the bottoms of troughs 42 and 44 are flush with or form continuations of flat surface 40 of the cover. Two pairs of two rows of holes 46 are provided in flat surface 40 of the cover for receiving the U-shaped insulation displacement portions 30 of terminals 26. The holes may extend completely through body portion 32 of the cover, but, conventionally, the holes are just deep enough to accommodate the insulation displacement portions of the terminals as the insulation displacement portions pierce through the ribbon cable. It can be seen that the holes in each pair of two rows are arranged staggered in each pair of rows. If conductors 14 are on 25 mil centerline spacing, the holes in the two rows of each pair are spaced on the order of 50 mils. In operation, as cover 17 is used to force conductors 14 of ribbon cable 12 into insulation displacement portions 30 of terminals 26. The undulated surface of the ribbon cable seats into troughs 42 and 44 which, thereby, aligns or registers the conductors with holes 46 and the insulation displacement portions of the terminals. With the cable embraced between surface 40 of the cover and cable-receiving face 22 of the housing, forcing the cover into a fully latched position on the housing effects insulation displacement termination of all of the terminals with all of the conductors of the ribbon cable.

Strain relief member 18 also is a unitarily molded component of dielectric material, such as plastic or the like, and has a pair of latch arms 48 at opposite ends thereof, with the latch arms having inwardly directed hook portions **48*a*. The hook portions snappingly engage over shoulders 50 at opposite ends of cover 17. The strain relief member has an elongated body portion 52 provided with a longitudinally extending slot 54 completely through the cover. In assembly, ribbon cable 12 is inserted through slot 54 in the direction of arrow "A", and the cable then is wrapped around one edge of body portion 32 of cover 17 so that a trimmed end of the cable can be positioned against surface 40 of the cover. Therefore, the cable is assembled in a sort of serpentine configuration through slot 54 in strain relief member 18 and about body portion 32 of cover 17, whereupon the strain relief member clamps the cable against a back side 56** of the cover when the strain relief member is clampingly latched to the cover.

Figure 2:
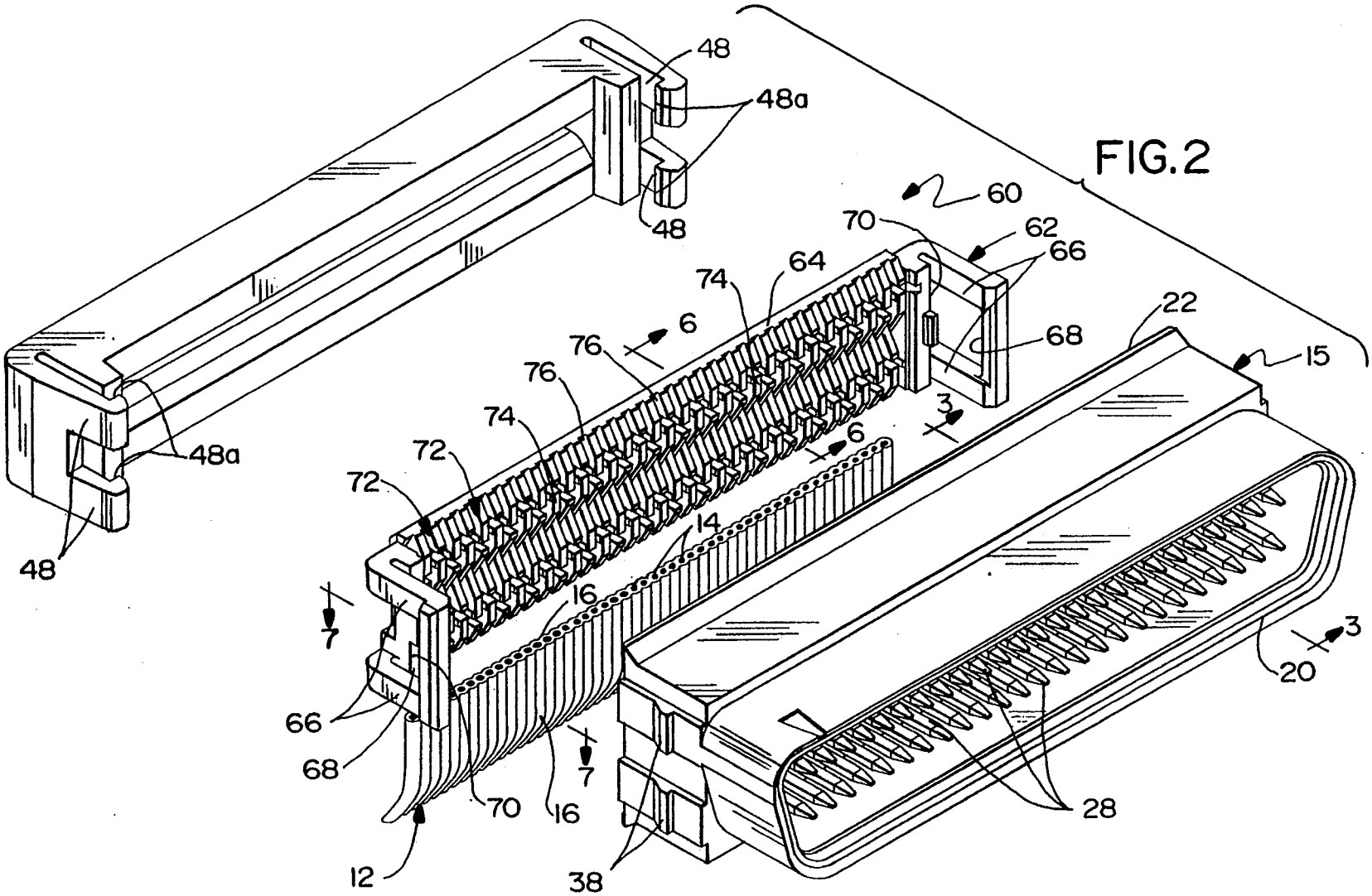
FIG. 2 is an exploded perspective view of the connector assembly of the invention.
Figure 3:
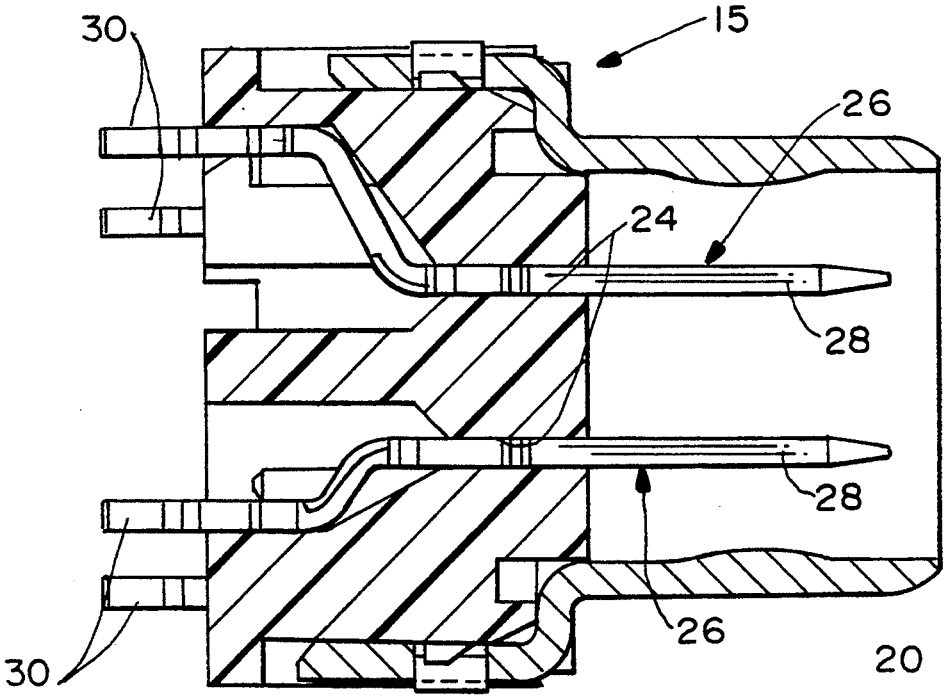
FIG. 3 is a vertical section, on an enlarged scale, through the housing and taken generally along line 3—3 of FIG. 2.
Figure 4:
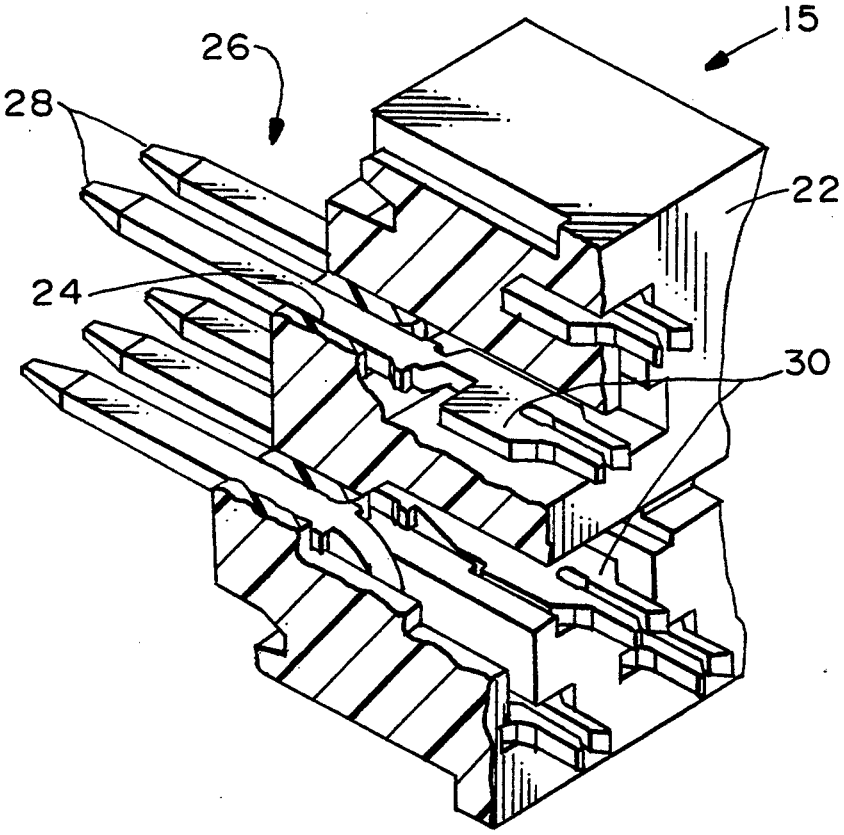
FIG. 4 is a fragmented perspective view of a portion of the housing and terminals of FIG. 3.

FIG. 2 shows an electrical connector, generally designated 60, embodying the concepts of the invention. Ribbon cable 12, housing 15 and strain relief member 18 of connector 60 are identical to those components of prior art connector assembly 10 described above and shown in FIG. 1. Therefore, the details of the ribbon cable, housing and strain relief member will not be repeated, and like reference numerals have been applied in FIG. 2 corresponding to like items described in relation to FIG. 1. However, FIGS. 3 and 4 shows a section through housing 15 to illustrate the configuration of and relationship between terminals 26, and to show the flat nature of cable-receiving face 22 of the housing. FIGS. 3 and 4 also shows that the housing has a dielectric body 15*a* and a conventional conductive shield 15*b*. As pointed out in the "Background," housing 15 of the prior art remains substantially unchanged and no major modifications need be made thereto. Only the cover of the connector is changed, as described immediately below.

More particularly, connector 60 of the invention includes a cover, generally designated 62, having an elongated body 64 with flexible latch arms 66 at opposite ends thereof. The latch arms define openings 68 for latchingly engaging latch bosses 38 of housing 15. Hook portions 48*a* of latch arms 48 of strain relief member 18 latchingly engage shoulders or surfaces 70 at opposite ends of the cover.

Figure 5:
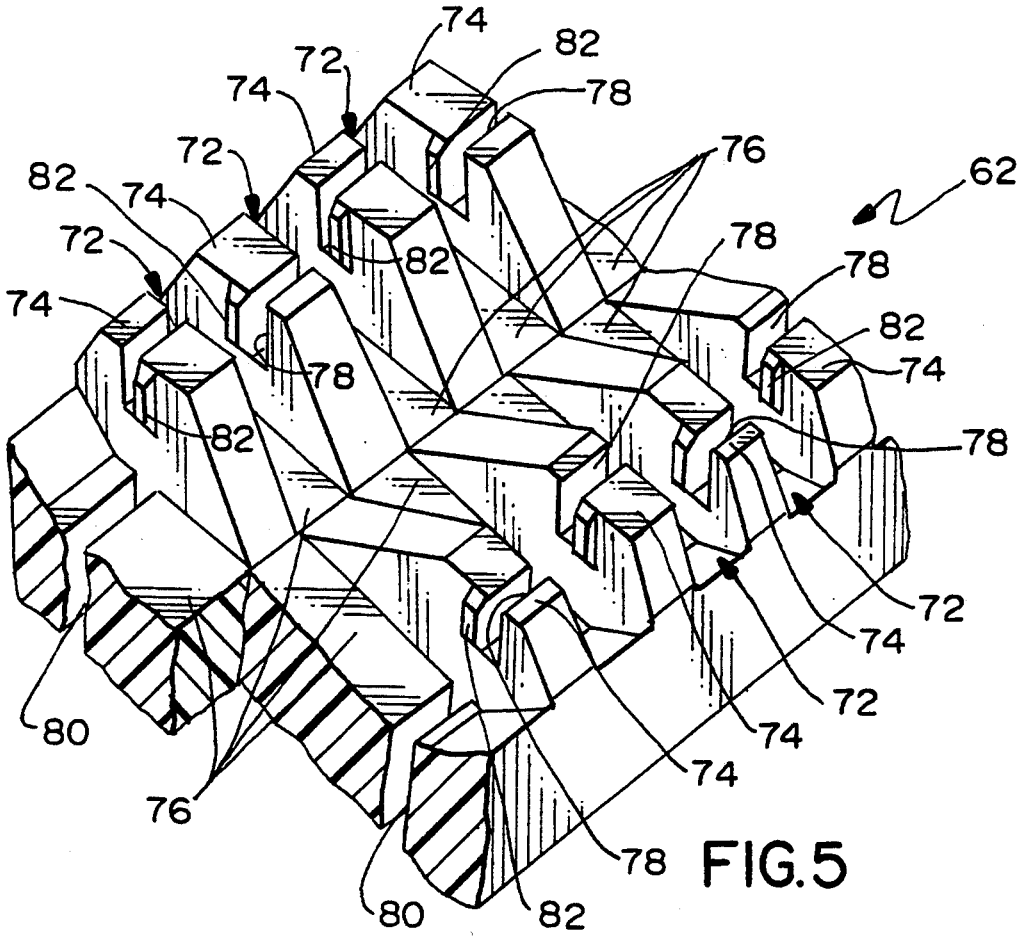
FIG. 5 is a fragmented perspective view, on an enlarged scale, of the cable-embracing face of the cover.
Figure 6:
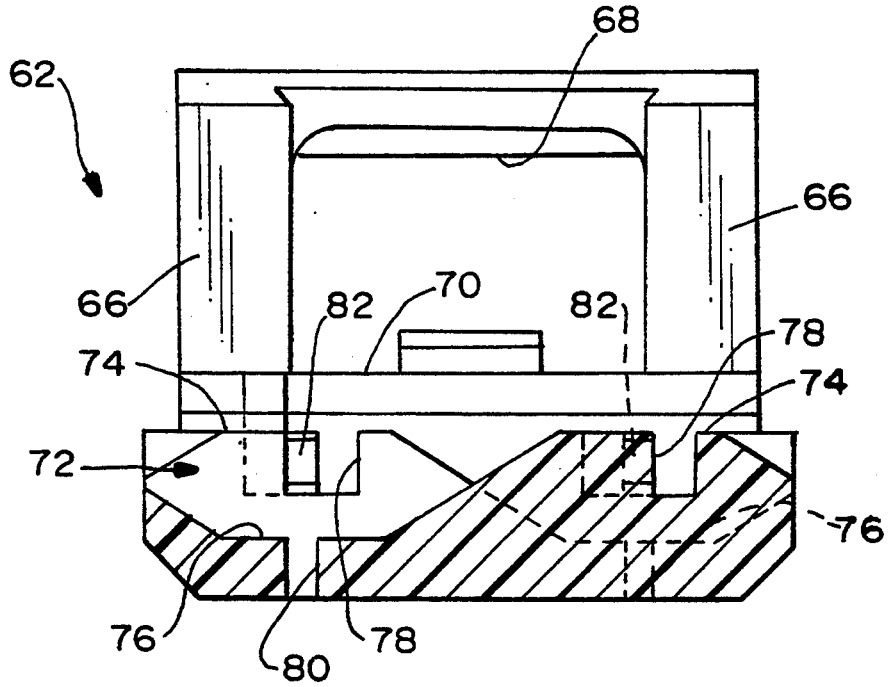
FIG. 6 is a vertical section, on an enlarged scale, through the cover and taken generally along line 6—6 of FIG. 2.

Referring to FIGS. 5 and 6 in conjunction with FIG. 2, cover 62 has a surface which defines a plurality of parallel conductor support channels, generally designated 72. Each channel defines an upper conductor support level 74 and a lower conductor support level 76 which are arranged such that a lower conductor support level of one channel is between two upper conductor support levels of adjacent channels. This commonly is called a "hill and dale" configuration. Transverse insulation displacement termination slots 78 are provided in each upper conductor support level 74 for receiving U-shaped insulation displacement portions 30 of terminals 26. Other slots 80 are shown in FIGS. 5 and 6 in the lower conductor support levels 76, but these slots simply are provided as "core-out" access areas to facilitate molding cover 62 integrally of plastic material.

Figure 7:
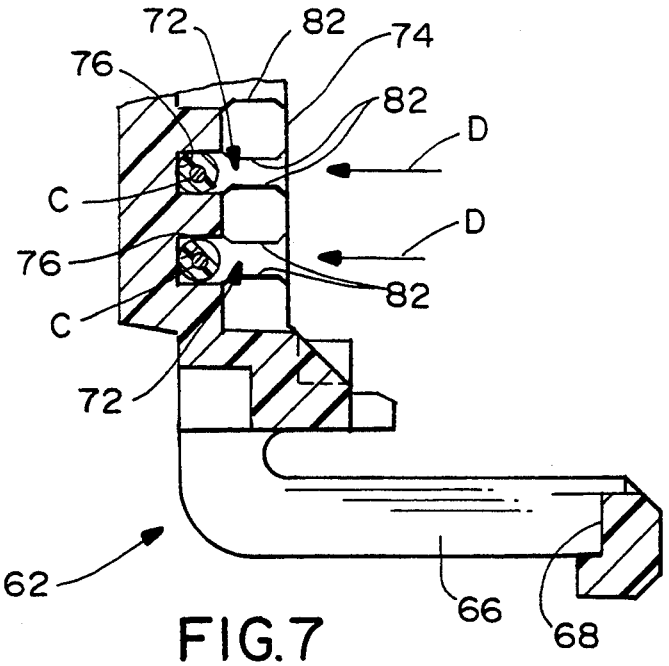
FIG. 7 is a horizontal section, on an enlarged scale, through the cover and taken generally along line 7—7 of FIG. 2.

The invention contemplates a unique system wherein conductor hold down means are operatively associated with each conductor support channel 72 to hold a respective conductor of ribbon cable 12 down into the channel. Specifically, projections 82 are molded integrally with cover 62 and protrude into each channel above the lower conductor support level 76 thereof. The projections are provided on opposite sides of each channel and, as best seen in FIG. 7, are spaced apart less than the diameter of a conductor "C". Therefore, the conductors can be pressed into conductor support channels 72 in the direction of arrows "D" (FIG. 7) past projections 82 in a type of snap-action. The conductors will be held below upper conductor support levels 74 and above lower conductor support levels 76, as seen clearly in FIG. 7.

An advantage of providing conductor hold down means in the form of projections 82 concerns the inability of providing precision and consistency with plastic components over time. In particular, as pointed out in the "Background," above prior art "hill and dale" systems employ mirror imaged housing components to embrace and sandwich the ribbon cable therebetween. The conductors of the ribbon cable are forced in their respective conductor support channels between the mirror imaged housing components. While such a structure can operate effectively, it inherently presents some problems due to the cable being aligned between two plastic "hill and dale" members, each of which may vary in size slightly because of changes in molding conditions, lot to lot variability in the plastic material, differences in mold tooling as well as wear of the mold. With the connector system of the invention, precision tooling is used to "assemble" the ribbon cable to cover 62 prior to assembling the cover to housing 15 and terminating the conductors to terminals 26.

Figure 8:
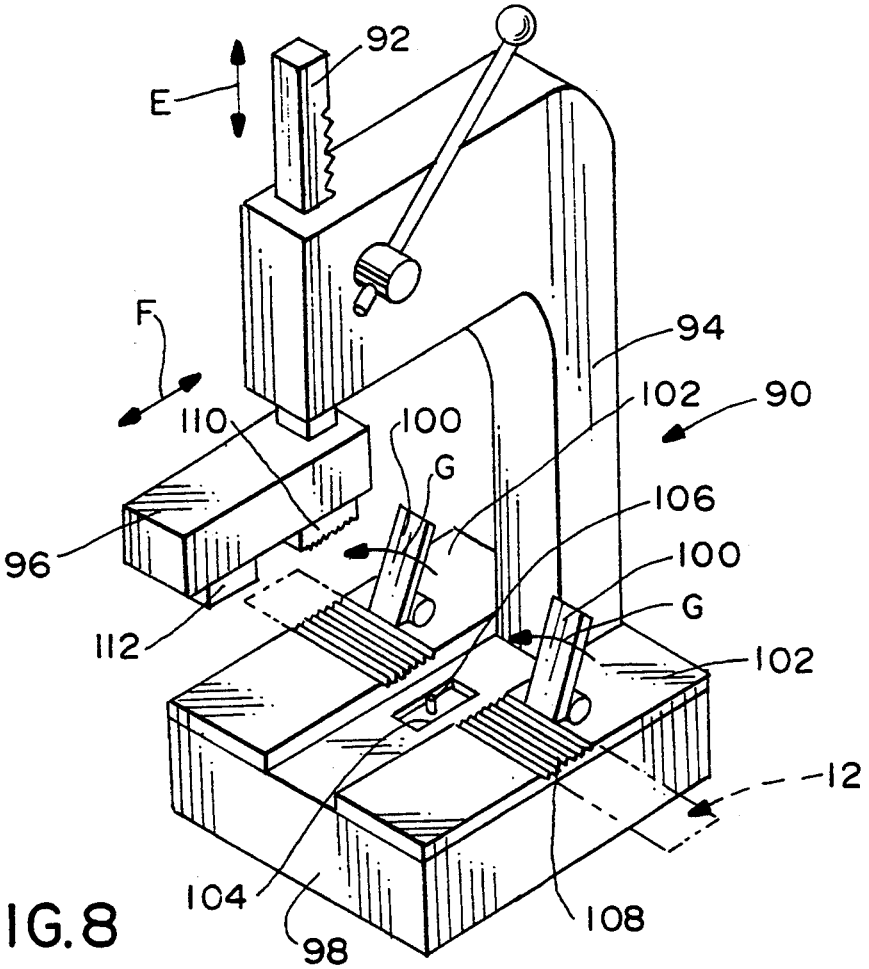
FIG. 8 is a perspective view of a tool for use in assembling the ribbon cable to the cover.

More particularly, reference is made to FIG. 8 wherein a tool, generally designated 90, is somewhat schematically illustrated, it being understood that other types of tools can be designed. Tool 90 is in the form of a hand, pneumatic or hydraulic press having a piston or ram 92 mounted in a support arm 94 for reciprocation in the direction of double-headed arrow "E". A two-position slide 96 is mounted on the lower distal end of piston 92 for adjustment in the direction of double-headed arrow "F". Arm 94 projects upwardly from a base 98 which has a pair of upwardly projecting spring loaded cable retainers 100 above a pair of base plates 102. A cavity 104 is formed in base 98 between base plates 102. The cavity is of a size/configuration for nesting a single cover 62 therewithin. An alignment pin 106 may be provided in cavity 104 for insertion into an alignment hole (not shown) in the cover to precisely align the cover for a precision operation. The cover will be generally flush with the tops of base plates 102. A ribbon cable 12 is shown in phantom on base plates 102 and spanning cavity 104 within which a cover is positionable. Grooves 108 may be formed in the upwardly facing surface of base plates 102 and running parallel to the length of the ribbon cable. The grooves have a profile corresponding to the undulated profile of the ribbon cable. Again, these grooves can be machined with considerable precision, since base 98, base plates 102, pin 106, cable retainers 100, etc. all can be fabricated precisely of metal material with a precision which simply cannot be accomplished in molded plastic.

Slide 96 has two press plates 110 and 112 on the underside thereof. Press plate 110 has a "hill and dale" profile which is a mirror image of the channelled profile of cover 62. It is precisely machined of metal material and is effective to drive the individual conductors of the ribbon cable into the channels of the cover as the individual insulated conductors are cut and separated from each other. That is, as the press plate forces the individual conductors towards cover 62, the press plate and cover cut and separate the individual conductors. Press plate 112 comprises a connector housing retainer and aligner for mounting one of the housings 15.

In operation of tool 90, a ribbon cable 12 is positioned across the base of the tool as seen in FIG. 8, spanning a cover 62 positioned within cavity 104. Cable retainers 100 are pivoted in the direction of arrows "G" to hold the cable in position. The cable retainers are spring loaded to a hold down position. The tool then is actuated to drive piston 92, slide 96 and press plate 110 downwardly into engagement with the cable to cause the press plate 110 and the "hill and dale" profile of cover 62 to interact to cut and separate the individual conductors of the cable and drive the conductors into the conductor support channels 72 of the cover positioned within cavity 104 of the tool. It should be noted that certain insulation materials will have a tendency to stretch rather than be cut. However, in such a case, the conductors would still be separated. Press plate 110 is effective to separate or isolate the individual insulated conductors as they are driven into the conductor support channels. Hold down projections 82 of the cover hold the individual conductors in their support channels and prevent the conductors from coming out the channels which could result in misalignment of the conductors and shorting between the conductors upon assembly to housing 15 and termination with terminals 26. As such, hold down projections 82 act as the sole means for retaining each conductor within the conductor support channel prior to termination of the connector to the ribbon cable to terminate the connector with the ribbon cable. In the alternative, such projections 82 could be eliminated and the support channels dimensioned to securely hold the separated conductors within the channels.

Slide 96 then is adjusted to bring a connector housing 15 (which is retained and aligned by press plate 112) into alignment with cavity 104 and the "assembled" cover and cable thereat. The tool again is actuated to drive piston 92, slide 96, press plate 112 and the housing 15 downwardly into assembly with the cover and cable.

By utilizing the press plate 112 to force the ribbon cable into cover 62, precise positioning of the cable may be maintained. In addition, the shearing edges of the "hill and dale" profile may also easily be maintained in their desired sharp condition. Further, the positioning of the cover 62, cable 12 and housing 15 relative to each other may also be maintained better due to a reduction in the number of components (particularly plastic components) fitting together to effect the termination.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

We claim:

1. In an electrical connector for insulation displacing termination of ribbon cable having insulated conductors on predetermined close centerline spacing, including a dielectric housing having a mating face, an opposed cable-receiving face and a plurality of terminal-receiving passages extending between the faces, a plurality of terminals received in the passages, each terminal including a mating portion toward said mating face and a slotted U-shaped insulation displacement portion toward the cable-receiving face, the insulation displacement portions of the terminals being arranged staggered in at least two rows, and a dielectric cover for forcing the conductors into the U-shaped insulation displacement portions and embracing the cable between the cover and the cable-receiving face of the housing, the cover including surface means for engaging the cable and recess means in the surface means for receiving the U-shaped insulation displacement portions of the terminals, wherein the improvement comprises:

said surface means of the cover define a plurality of parallel conductor support channels, each of the channels defining upper and lower conductor support levels arranged such that a lower conductor support level of one channel is between two upper conductor support levels of adjacent channels, and conductor hold down means operatively associated with each channel to hold a respective conductor therein, whereby the ribbon cable can be pressed into the conductor support channels of the cover and held on the cover for subsequent termination of the cable to the terminals on the connector housing.

2. In an electrical connector as set forth in claim 1, wherein said recess means comprise transverse slots in the upper conductor levels.

3. In an electrical connector as set forth in claim 1, wherein said conductor support channels are spaced on the order of 25 mils to accommodate a 25 mil centerline spacing of the ribbon cable.

4. In an electrical connector as set forth in claim 1, wherein said cover is molded of dielectric material, and said conductor hold down means comprise integral projections which protrude into each conductor support channel above the lower conductor support level thereof.

5. In combination with the electrical connector of claim 1, a ribbon cable in which the insulation thereof is cut between the conductors in an area embraced by the cover at the conductor support channels.

6. In an electrical connector as set forth in claim 1, wherein said conductor hold down means is adapted to be the sole means for retaining each conductor of said ribbon cable in said conductor support channels prior to termination of the cable to the terminals on the connector housing.

7. In an electrical connector as set forth in claim 4, wherein said conductor integral projections are adapted to be the sole means for retaining each conductor of said ribbon cable in said conductor support channels prior to termination of the cable to the terminals on the connector housing.

8. A method of terminating an electrical connector for insulation displacing termination of ribbon cable having insulated conductors on predetermined close centerline spacing, the connector including a dielectric housing having a mating face, an opposed cable-receiving face and a plurality of terminal-receiving passages extending between the faces, a plurality of terminals received in the passages, each terminal including a mating portion toward said mating face and a slotted U-shaped insulation displacement portion toward the cable-receiving face, the insulation displacement portions of the terminals being arranged staggered in at least two rows, and a dielectric cover for forcing the conductors into the U-shaped insulation displacement portions and embracing the cable between the cover and the cable-receiving face of the housing, the cover including surface means for engaging the cable and recess means in the surface means for receiving the U-shaped insulation displacement portions of the terminals, said surface means having a plurality of parallel conductor support channels, each of the channels defining upper and lower conductor support levels arranged such that a lower conductor support level of one channel is between two upper conductor support levels of adjacent channels comprising the steps of:

providing a press tool having a reciprocally movable press plate, said press plate having a cable engaging surface with a plurality of parallel conductor support channels, each of the channels defining upper and lower conductor support levels arranged such that a lower conductor support level is positioned between two upper conductor support levels of adjacent channels;

positioning said cover in a cover nest of said press tool with said surface means facing in a first direction, said cover being oriented such that the upper conductor support levels of said press tool are aligned with the lower conductor support levels of said cover and the lower conductor support levels of said press tool are aligned with the upper conductor support levels of said cover;

positioning said ribbon cable having insulated conductors adjacent said cover and said cover nest;

engaging one side of said ribbon cable with said press plate to press the ribbon cable in a direction opposite said first direction and against said cover in order to separate a portion of said conductors of said ribbon cable and press said separated conductors into said conductor support channels of the cover to create a cover and cable subassembly; and moving said housing relative to said cover and cable subassembly to force said U-shaped insulation displacement portions of the terminals into engagement with said conductors to terminate said electrical connector to said cable.

9. The method of claim 8, wherein said press tool includes a housing nest for retaining said housing prior to termination of said cable to said U-shaped insulation displacement portions of the terminals, and said method further includes positioning a housing in said housing nest and aligning said housing nest and said housing with said cover and cable subassembly prior to said moving step.

10. The method of claim 8 wherein said cover includes conductor hold down means operatively associated with each channel to hold a respective conductor therein and said engaging step further includes pressing said separated conductors into engagement with said conductor hold down means.

11. The method of claim 10 wherein said conductor hold down means comprise integral projections that protrude into each conductor support channel, and said integral projections are the sole means for retaining each conductor of said ribbon cable within its respective conductor support channel prior to said moving step and said engaging step further includes pressing said separated conductors into engagement with said integral projections.

* * * * *